US007651203B2

(12) United States Patent
Yamada et al.

(10) Patent No.: US 7,651,203 B2
(45) Date of Patent: Jan. 26, 2010

(54) INKJET RECORDING DEVICE, EJECTING DEVICE PROVIDED THEREIN, AND METHOD OF CALIBRATING EJECTION CHARACTERISTIC FOR DROPLET

(75) Inventors: Takahiro Yamada, Hitachinaka (JP); Hitoshi Kida, Hitachinaka (JP); Satoru Tobita, Hitachinaka (JP); Kenichi Kugai, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 441 days.

(21) Appl. No.: 11/610,152

(22) Filed: Dec. 13, 2006

(65) Prior Publication Data

US 2007/0132813 A1 Jun. 14, 2007

(30) Foreign Application Priority Data

Dec. 14, 2005 (JP) ..... P2005-359767

(51) Int. Cl.
*B41J 2/045* (2006.01)

(52) U.S. Cl. ..... 347/68

(58) Field of Classification Search ..... 347/68, 347/69–72; 400/124.16

See application file for complete search history.

(56) References Cited

U.S. PATENT DOCUMENTS 4,704,675 A 11/1987 Jacobs et al.
5,818,473 A 10/1998 Fujii et al. ..... 347/11
7,517,061 B2 * 4/2009 Sakamoto et al. ..... 347/68
2001/0052738 A1 12/2001 Kitahara
2006/0082605 A1 4/2006 Arakawa et al.
2006/0268072 A1 11/2006 Yamada et al. ..... 347/ 68

FOREIGN PATENT DOCUMENTS

GB 2325438 A 11/1998

(Continued)

OTHER PUBLICATIONS

The Combined Search and Substantive Examination Report issued by the British Patent Office in respect of this application on Mar. 26, 2007, pp. 1-6.

(Continued)

*Primary Examiner*—K. Feggins
(74) *Attorney, Agent, or Firm*—Whitham Curtis Christofferson & Cook, PC

(57) ABSTRACT

A droplet ejecting device includes a nozzle unit, a piezoelectric member and a drive voltage generating unit. The piezoelectric member has a common electrode and a discrete electrode. A first differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values. The drive voltage generating unit generates a drive voltage having a range between a first negative voltage Ve1 and a first positive voltage Ve2, and applies the drive voltage between the common electrode and the discrete electrode. Vbp, Vbn, Ve1, and Ve2 are set such that Vbn<Ve1<0 and 0<Ve2<Vbp.

17 Claims, 9 Drawing Sheets

FOREIGN PATENT DOCUMENTS

| | | | |
|---|---|---|---|
| GB | 2 400 080 | A | 6/2004 |
| GB | 2 403 455 | A | 5/2005 |
| JP | 60104343 | A | 11/1983 |
| JP | 3-251454 | | 11/1991 |
| JP | 6- 344573 | | 12/1994 |
| JP | 2001-277525 | | 10/2001 |
| JP | 2006-315326 | | 11/2006 |

OTHER PUBLICATIONS

A Search Report issued by British Patent Office on Apr. 16, 2008, in relation to the corresponding British application, pp. 1-2.

* cited by examiner

FIGB 4

INKJET RECORDING DEVICE, EJECTING DEVICE PROVIDED THEREIN, AND METHOD OF CALIBRATING EJECTION CHARACTERISTIC FOR DROPLET

BACKGROUND OF THE INVENTION

1. Field of the Invention

The present invention relates to a droplet ejecting device for recording high-quality images quickly and reliably, a method of calibrating ejection characteristics for this droplet ejecting device, and an inkjet recording device equipped with the droplet ejecting device.

2. Description of Related Art

On-demand multi-nozzle inkjet recording heads having a plurality of integrated nozzles are well known in the art. With this type of inkjet recording head, it is important to produce ink droplets from each nozzle with a uniform ejection velocity and mass in order to record high-quality images quickly and reliably.

In an on-demand inkjet recording head having a push-type piezoelectric element system, a pressure chamber having orifices for nozzle holes includes a diaphragm serving as one wall of the pressure chamber. Bar-shaped piezoelectric elements generate longitudinal vibrations that push the diaphragm, reducing the volume in the pressure chamber and causing an ink droplet to be ejected through a nozzle hole. Conventionally, methods have been adopted to improve the precision of various components constituting the piezoelectric elements, the pressure chamber, and the like and to improve the precision for assembling such components through adhesive bonding and the like in order to reduce variations in the mass and velocity of ink droplets ejected from this recording head.

However, this method has led to such problems as an increased cost in the manufacturing of parts and an increase in assembly time. To avoid these problems, Japanese unexamined patent application publication No. 2001-277525 and others propose a method of reducing variations in the mass and velocity of ink droplets ejected from each nozzle by suitably adjusting the degree of polarization in the piezoelectric elements, that is, a polarization calibration method. This method can provide an inkjet recording head capable of improving the uniformity of ink droplet ejection, without the addition of parts or circuits, but merely adding a calibration step in the manufacturing process.

However, when calibrating the degree of polarization of the piezoelectric elements in this conventional method, it is necessary to repolarize the piezoelectric elements in an elevated temperature state. Consequently, the method requires a heating device for heating the piezoelectric elements and considerable time and effort to perform this heating, making it difficult to sufficiently reduce costs and improve productivity.

As a method for resolving these problems, it is conceivable to conduct polarization at ambient temperatures near room temperature (around 25° C.). However, the polarization of the piezoelectric elements tends to be set lower than the degree of polarization set at high temperatures. It has been determined that, when polarizing piezoelectric elements by applying a drive voltage thereto, the calibration of polarization breaks down as the drive time elapses, resulting in a wide variation of velocities among nozzles.

SUMMARY OF THE INVENTION

In view of the foregoing, it is an object of the present invention to provide a droplet ejecting device, a method of calibrating ejection characteristics, and an inkjet recording device equipped with the droplet ejecting device.

More specifically, it is an object of the present invention to provide a method of calibrating the polarization of piezoelectric elements in an inkjet recording device that can be performed at room temperature and, moreover, that can maintain the calibrated state of polarization, even after a drive voltage has been applied to the piezoelectric elements over a long period of time. It is another object of the present invention to provide a droplet ejecting device and inkjet recording device capable of recording high-quality images at a high rate of speed and with excellent reliability through this calibration method.

In order to attain the above and other objects, the present invention provides a droplet ejecting device including a nozzle unit, a piezoelectric member and a drive voltage generating unit. The nozzle unit ejects ink droplets. The piezoelectric member has a common electrode and a discrete electrode, and is polarized based on a polarization voltage applied between the common electrode and the discrete electrode, and expands and contracts based on change in a voltage difference between the common electrode and the discrete electrode. A first differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values. The drive voltage generating unit generates a drive voltage having a range between a first negative voltage Ve1 and a first positive voltage Ve2, and apply the drive voltage between the common electrode and the discrete electrode. Vbp, Vbn, Ve1, and Ve2 are set such that $Vbn<Ve1<0$ and $0<Ve2<Vbp$.

Another aspect of the present invention provides a droplet ejecting device including a nozzle unit, a piezoelectric member and a drive voltage generating unit. The nozzle unit ejects ink droplets. The piezoelectric member has a common electrode and a discrete electrode, and is polarized based on a polarization voltage applied between the common electrode and the discrete electrode, and expands and contracts based on change in a voltage difference between the common electrode and the discrete electrode. A secondary differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values. The drive voltage generating unit generates a drive voltage having a range between a first negative voltage Ve1 and a first positive voltage Ve2, and apply the drive voltage between the common electrode and the discrete electrode. Vbp, Vbn, Ve1, and Ve2 are set such that $Vbn<Ve1<0$ and $0<Ve2<Vbp$.

Another aspect of the present invention provides a method of calibrating ejection characteristics for a droplet ejecting device including a plurality of nozzles ejecting ink droplets; and a plurality of piezoelectric elements provided in one-to-one correspondence with the plurality of nozzles, each piezoelectric element having a common electrode and a discrete electrode, and being polarized based on a polarization voltage applied between the common electrode and the discrete electrode, and expanding and contracting based on a change in a voltage difference between the common electrode and the discrete electrode. The method including a first step for measuring variation in droplet ejection characteristics among the plurality of nozzles; a second step for applying a polarization voltage to the plurality of piezoelectric elements based on the measured variation so that droplet ejection velocity from each nozzle is equivalent to or lower than that of the nozzle having the slowest droplet ejection velocity; and a third step for applying a drive voltage Ve to the plurality of piezoelectric elements in order to uniformly increase ejection velocity of the plurality of nozzles.

Another aspect of the present invention provides an inkjet recording device including a nozzle unit, a piezoelectric member and a drive voltage generating unit. The nozzle unit ejects ink droplets. The piezoelectric member has a common electrode and a discrete electrode, and is polarized based on a polarization voltage applied between the common electrode and the discrete electrode, and expands and contracts based on change in a voltage difference between the common electrode and the discrete electrode. A first differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values. The drive voltage generating unit generates a drive voltage having a range between a first negative voltage Ve1 and a first positive voltage Ve2, and apply the drive voltage between the common electrode and the discrete electrode. Vbp, Vbn, Ve1, and Ve2 are set such that Vbn<Ve1<0 and 0<Ve2<Vbp.

Another aspect of the present invention provides an inkjet recording device including a nozzle unit, a piezoelectric member and a drive voltage generating unit. The nozzle unit ejects ink droplets. The piezoelectric member has a common electrode and a discrete electrode, and is polarized based on a polarization voltage applied between the common electrode and the discrete electrode, and expands and contracts based on change in a voltage difference between the common electrode and the discrete electrode. A secondary differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values. The drive voltage generating unit generates a drive voltage having a range between a first negative voltage Ve1 and a first positive voltage Ve2, and apply the drive voltage between the common electrode and the discrete electrode. Vbp, Vbn, Ve1, and Ve2 are set such that Vbn<Ve1<0 and 0<Ve2<Vbp.

BRIEF DESCRIPTION OF THE DRAWINGS

The above and other objects, features and advantages of the invention will become more apparent from reading the following description of the preferred embodiments taken in connection with the accompanying drawings in which:

FIGS. 4A to 4D are graphs for describing the calibration of the ink ejection velocity when calibrating the recording head through repolarization;

DETAILED DESCRIPTION OF THE PREFERRED EMBODIMENTS

Figure 1:
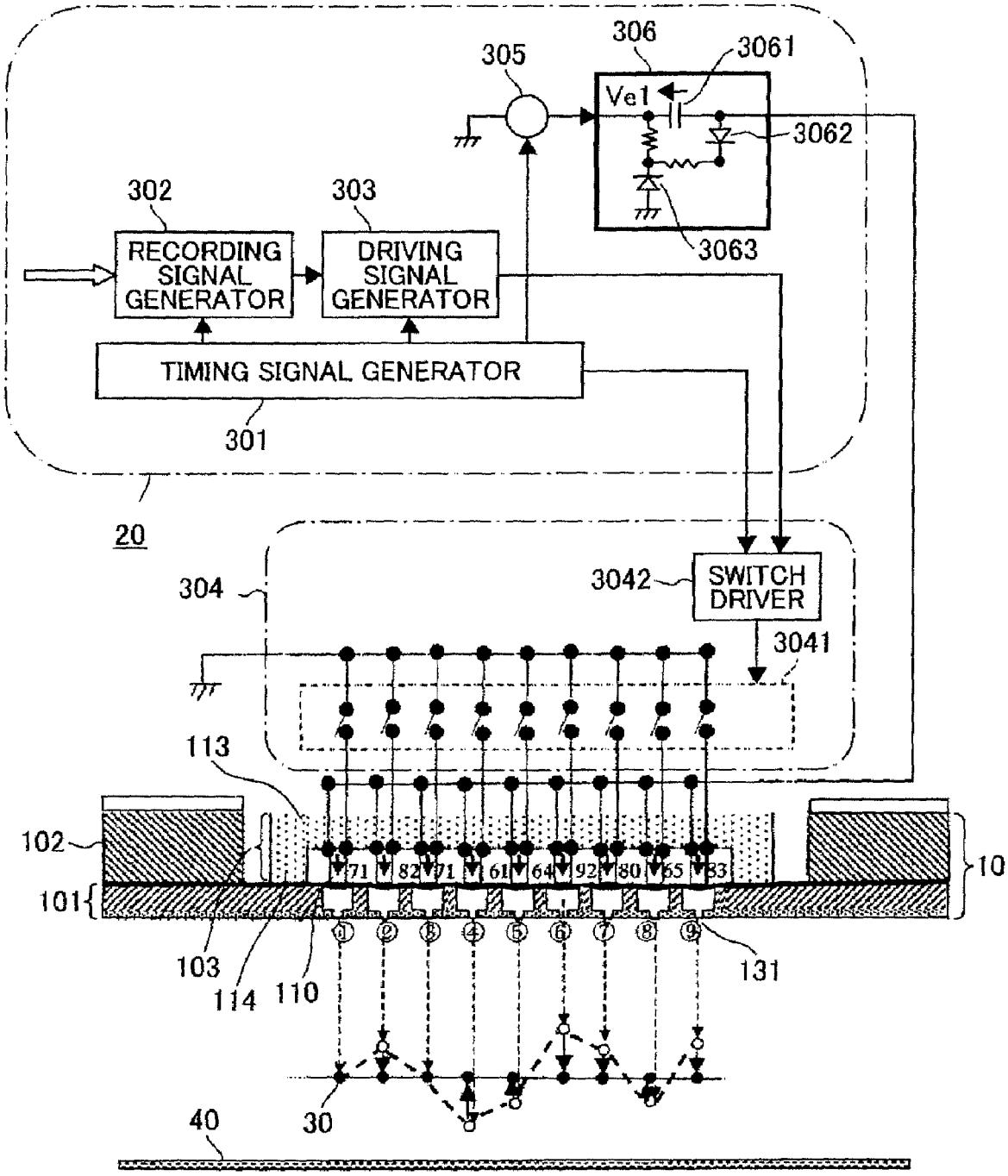
FIG. 1 is a schematic diagram illustrating a droplet ejecting device according to a first embodiment.

A droplet ejecting device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the droplet ejecting device is disposed in an orientation in which it is intended to be used.

(1) Structure of a Droplet Ejecting Device According to a First Embodiment

FIG. 1 is a schematic diagram showing the structure of a droplet ejecting device according to a first embodiment of the present invention. As shown in FIG. 1, the droplet ejecting device includes a recording head 10 and a recording head drive unit 20. Below, the recording head 10 and recording head drive unit 20 will be described in greater detail.

(1.1) Recording Head 10

Figure 2:
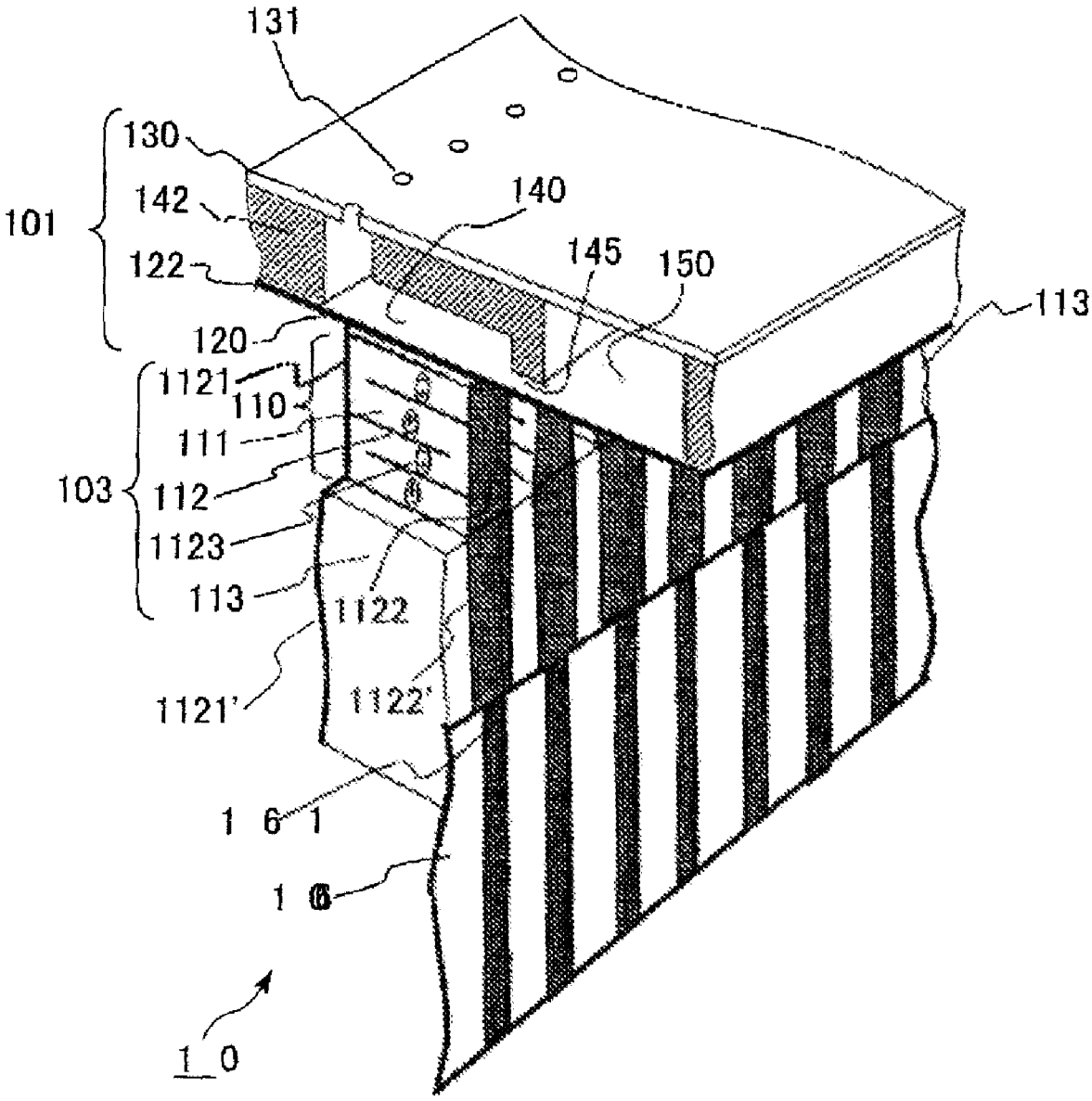
FIG. 2 is an enlarged perspective view showing the structure of a recording head in the droplet ejecting device of the preferred embodiment.

As shown in FIG. 1, the recording head 10 includes an ink channel unit 101, a recording head housing 102 holding the ink channel unit 101, and a piezoelectric element unit 103. As shown in FIG. 2, the ink channel unit 101 is formed by laminating and fixing an orifice plate 130, an ink channel forming plate 142, and a diaphragm forming plate 122 together in the order given. The piezoelectric element unit 103 is formed by fixing bar-shaped piezoelectric elements 110 to a base member 113 in a configuration resembling the teeth of a comb.

With this construction, n nozzles are formed in the recording head 10. The nozzles include a row of n nozzle holes 131 formed in the orifice plate 130 at a prescribed pitch. The ink channel unit 101 and recording head housing 102 combine to form an ink pressure chamber 140 in fluid communication with the nozzle holes 131, an ink inlet 145 for guiding ink to the ink pressure chamber 140, and a common ink chamber 150 for supplying ink to the ink inlet 145.

By fixing the diaphragm forming plate 122 to the ink channel forming plate 142, a diaphragm 120 forms at least one wall surface of the ink pressure chamber 140. One end of the piezoelectric elements 110 abuts the diaphragm 120 on the opposite side from the ink pressure chamber 140 and is fixed to the diaphragm 120 by an adhesive layer. Each nozzle has an identical structure.

The piezoelectric element 110 for each nozzle is fixed to the base member 113 by an adhesive or the like to construct the piezoelectric element unit 103. Columnar fixing parts 114 (see FIG. 1) are formed one on either side surface of the base member 113 with respect to the direction in which the piezoelectric elements are aligned. A bottom surface of the fixing parts 114 is fixed to the ink channel unit 101 by adhesive or the like. Since the ink channel unit 101 is fixed by adhesive to the recording head housing 102, the bottom surface of the fixing parts 114 is fixed with respect to the recording head housing 102.

The piezoelectric element 110 has a layered structure, as shown in FIG. 2, with a plurality of layered piezoelectric elements 111 alternately laminated with layered electrodes 112. The electrodes 112 are arranged such that even numbered electrodes are connected to a common electrode 1121 formed along a side surface of the piezoelectric elements 110, while odd numbered electrodes are connected to discrete electrodes 1122, for example. The common electrode 1121 and discrete electrodes 1122 are connected to a respective common electrode 1121' and respective discrete electrodes 1122' formed on the top surface of the base member 113, which in turn are connected to flexible cable terminals 161 of a flexible cable 160.

As shown in FIG. 2, each of the piezoelectric elements 111 in the piezoelectric elements 110 has a remanent polarization 1123. The remanent polarization 1123 is formed by applying a polarization voltage across the common electrode 1121 and discrete electrodes 1122. The magnitude of the remanent polarization 1123 can be adjusted by modifying such conditions as the magnitude of the polarization voltage applied between the electrodes or the temperature during polarization to modify the degree of polarization in the piezoelectric elements 111.

The recording head 10 having this construction is driven by a signal supplied from the recording head drive unit 20 via the flexible cable 160.

(1.2) Recording Head Drive Unit 20

As shown in FIG. 1, the recording head drive unit 20 includes a recording data signal generating circuit 302, a piezoelectric element drive data signal generating circuit 303, a piezoelectric element drive switching circuit 304, a timing signal generating circuit 301, a piezoelectric element drive pulse wave generating circuit 305, and a piezoelectric element drive voltage polarity distribution circuit 306.

The piezoelectric element drive voltage polarity distribution circuit 306 is a clamp circuit and includes a capacitor 3061, a diode 3062, and a tuner diode 3063. The output voltage of the clamp circuit 306 is applied to the common electrode 1121 of the piezoelectric element 110.

The piezoelectric element drive switching circuit 304 includes switching elements 3041 connecting the discrete electrodes 1122 of the piezoelectric element 110 to ground, and a switching element drive circuit 3042 for driving the switching elements 3041.

Next, the operations of the recording head drive unit 20 according to the preferred embodiment will be described.

The recording data signal generating circuit 302 produces a recording data signal based on input data received from a host computer, such as a personal computer (not shown). The piezoelectric element drive data signal generating circuit 303 creates a drive data signal for driving the piezoelectric elements based on the recording data signal and a timing signal received from the timing signal generating circuit 301. The output signal from the piezoelectric element drive data signal generating circuit 303 controls the switching elements 3041 of the piezoelectric element drive switching circuit 304.

The discrete electrodes 1122 of the piezoelectric element 110 connected to the switching elements 3041 are selectively grounded by selectively turning on the switching elements 3041. Since the piezoelectric element drive pulse wave generating circuit 305 applies a pulse signal to the common electrode 1121 via the piezoelectric element drive voltage polarity distribution circuit 306, the pulse signal is applied to the selected piezoelectric elements 110. Accordingly, ink droplets are ejected from nozzles corresponding to the selected piezoelectric elements 110 toward a recording paper 40 (see FIG. 1).

A feature of the droplet ejecting device having this construction is the waveform of the pulse signal applied to the piezoelectric elements 110.

Figure 3A:
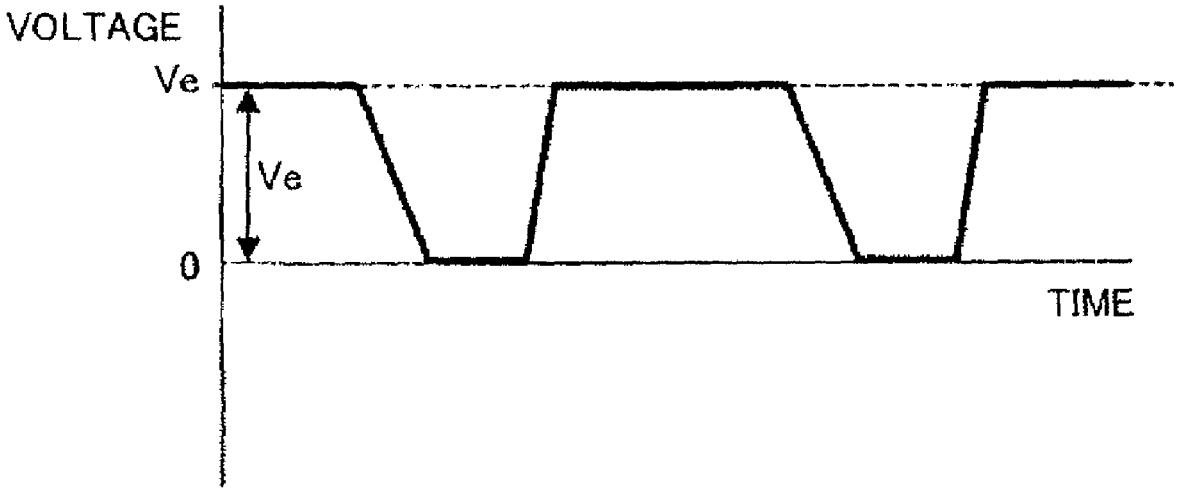
FIGS. 3A and 3B are waveform diagrams illustrating the operations of a recording head drive unit according to the first embodiment.

FIG. 3A shows the waveform of a pulse signal generated by the piezoelectric element drive pulse wave generating circuit 305. The pulse signal has a voltage amplitude Ve. Within this pulse waveform, ink is drawn into the ink pressure chamber 140 when the potential changes from Ve to 0 V and increases the pressure in the ink pressure chamber 140 when the potential changes from 0 V to Ve, causing an ink droplet 30 to be ejected. Conventional droplet ejecting devices have applied the pulse signal shown in FIG. 3A directly to the common electrode 1121 of the piezoelectric elements 110 as a drive signal for driving the piezoelectric elements.

Figure 3B:
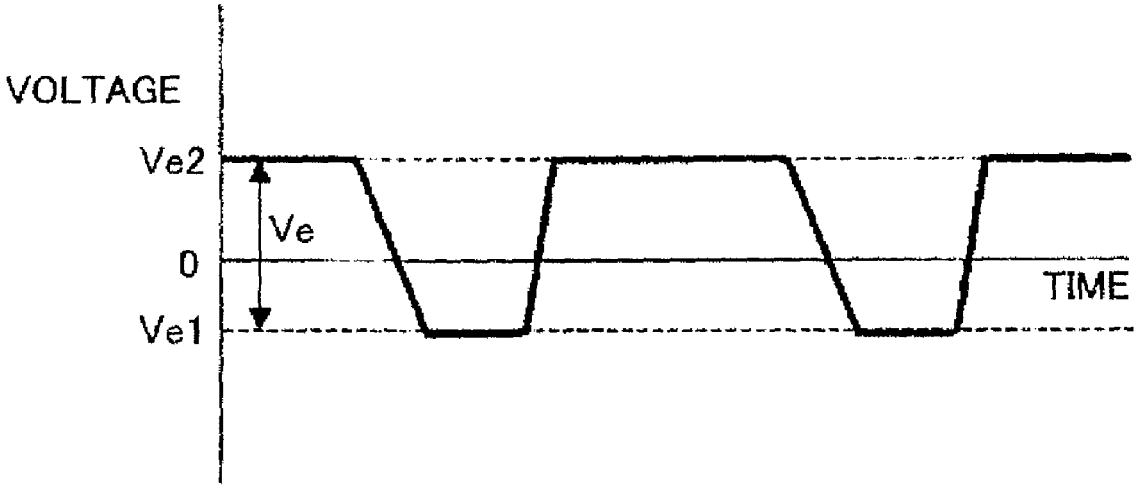

However, the droplet ejecting device of the preferred embodiment is configured to generate a pulse signal as shown in FIG. 3B through the clamp circuit 306 and to apply this pulse signal to the common electrode 1121. The waveform of the pulse signal shown in FIG. 3B is the same pulse signal shown in FIG. 3B shifted by a value Ve1 toward the negative potential. Specifically, the amplitude Ve of the drive voltage is divided between both directions of polarity, spanning between a voltage Ve2 on the positive side, the same direction as the direction of polarity when applying a polarization voltage to the piezoelectric elements 110, and a voltage Ve1 in the negative direction.

The clamp circuit 306 is set so that the voltage across the terminals of the tuner diode 3063 is about Ve1. Hence, the capacitor 3061 can be charged to the voltage Ve1 in the direction indicated by the arrow. Consequently, the pulse signal outputted from the piezoelectric element drive pulse wave generating circuit 305 is shifted in the negative direction by this voltage Ve1, producing a drive voltage for driving the piezoelectric elements that changes between both directions of polarity, as shown in FIG. 3B.

Next, a method of calibrating ejection characteristics for the droplet ejecting device having the above structure will be described.

(2) Method of Calibrating Ejection Characteristics

In FIG. 1, dotted lines extending downward from the nozzle holes denote the trajectories of ink droplets 30. Dots positioned in front of arrows included on the dotted lines indicate the positions of the ink droplets 30 along their trajectories a prescribed time after a drive signal is applied to the piezoelectric elements 110 to eject the ink droplets from the nozzles. Unfilled dots denote irregular positions caused by variations in the ink ejection characteristics of the nozzles, while filled dots indicate equivalent positions of ink droplets in their trajectories when the ejection characteristics of each nozzle are uniform. The transverse dotted line connecting all unfilled dots is provided to help visualize the variations in flight positions of the ink droplets. Similarly, the solid transverse line serves as a reference for ink droplets having no positional variation after the ejection characteristics of each nozzle has been calibrated. The circled numbers positioned directly under each of the nozzle holes 131 in FIG. 1 represent the nozzle numbers.

The method of calibrating ejection characteristics of the present invention is a method of correcting deviations in the ink droplet positions indicated by the unfilled dots to achieve the positions indicated by the filled dots. The steps of this method will be described below with reference to the flowchart in FIG. 10.

(2.1) Measuring the Magnitude of Variations Among Nozzles

Figure 4A:
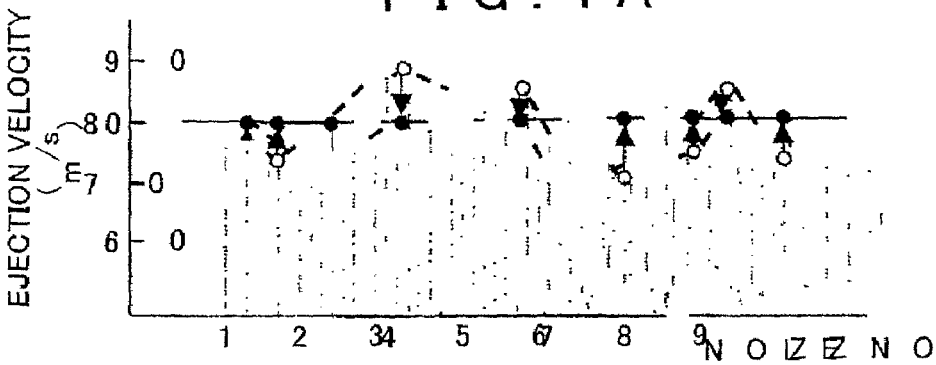
Figure 4A:
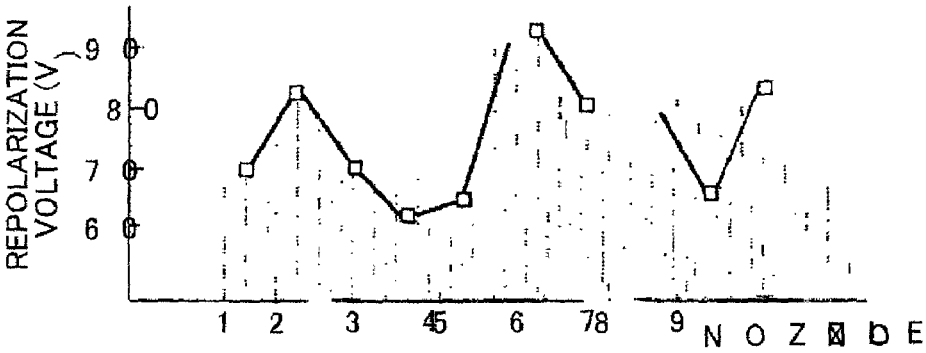

FIG. 4A is a graph showing the velocity of ink droplets ejected from each nozzle when a drive voltage of 28 V is applied to the piezoelectric elements 110 corresponding to these nozzles, wherein the horizontal axis indicates the nozzle number and the vertical axis indicates the ejection velocity.

In FIG. 4A, the plotted velocities for each nozzle have been connected with a dotted line to aid in visualizing the variations in ink droplet ejection among the nozzles. In order to calibrate these nozzles to achieve velocities along the solid line indicated in FIG. 4A, in S101 of FIG. 10 the magnitude of variations in the droplet ejection velocity is measured for all of the nozzles.

The method of measuring this variation is well known in the art and will not be described in detail here. However, variations may be found, for example, by applying a prescribed drive voltage across the common electrode 1121 and discrete electrode 1122 for each piezoelectric element 110 to eject an ink droplet and to measure the time required for the ink droplet ejected from the nozzle hole to reach a point 1 mm in front of the nozzle hole, for example.

In the example shown in FIG. 4A, the velocities of ink droplets ejected from all nozzles in the recording head 10 center on a point near 8 m/s. This variation in velocity causes deviations in the impact positions on the recording paper 40, reducing the quality of the image formed by the recording device. In this example, the velocities of ink droplets ejected from nozzles 1 and 3 are substantially the same at about 8 m/s and, hence, are similarly positioned along the trajectories shown in FIG. 1. However, the ejection velocities for nozzles 4, 5 and 8 exceed 8 m/s. Therefore, ink droplets ejected from these nozzles are positioned closer to the recording medium along the trajectories shown in FIG. 1 than the droplets ejected from nozzles 1 and 3. On the other hand, nozzles 2, 6, 7, and 9 have a slower ejection velocity than 8 m/s.

Consequently, ink droplets ejected from these nozzles are positioned closer to the nozzle holes along their trajectories than the positions of droplets ejected from nozzles 1 and 3. Since a recording device records images on a recording medium by ejecting ink droplets from the recording head while moving the recording medium relative to the recording head, the positions at which ink droplets impact the recording medium vary according to the positional variation shown in FIG. 1, causing a drop in image quality. In order to ensure that the recording device achieves a high recording quality, it is necessary to minimize variations in the ink droplet ejection velocity among all nozzles.

Figure 10:
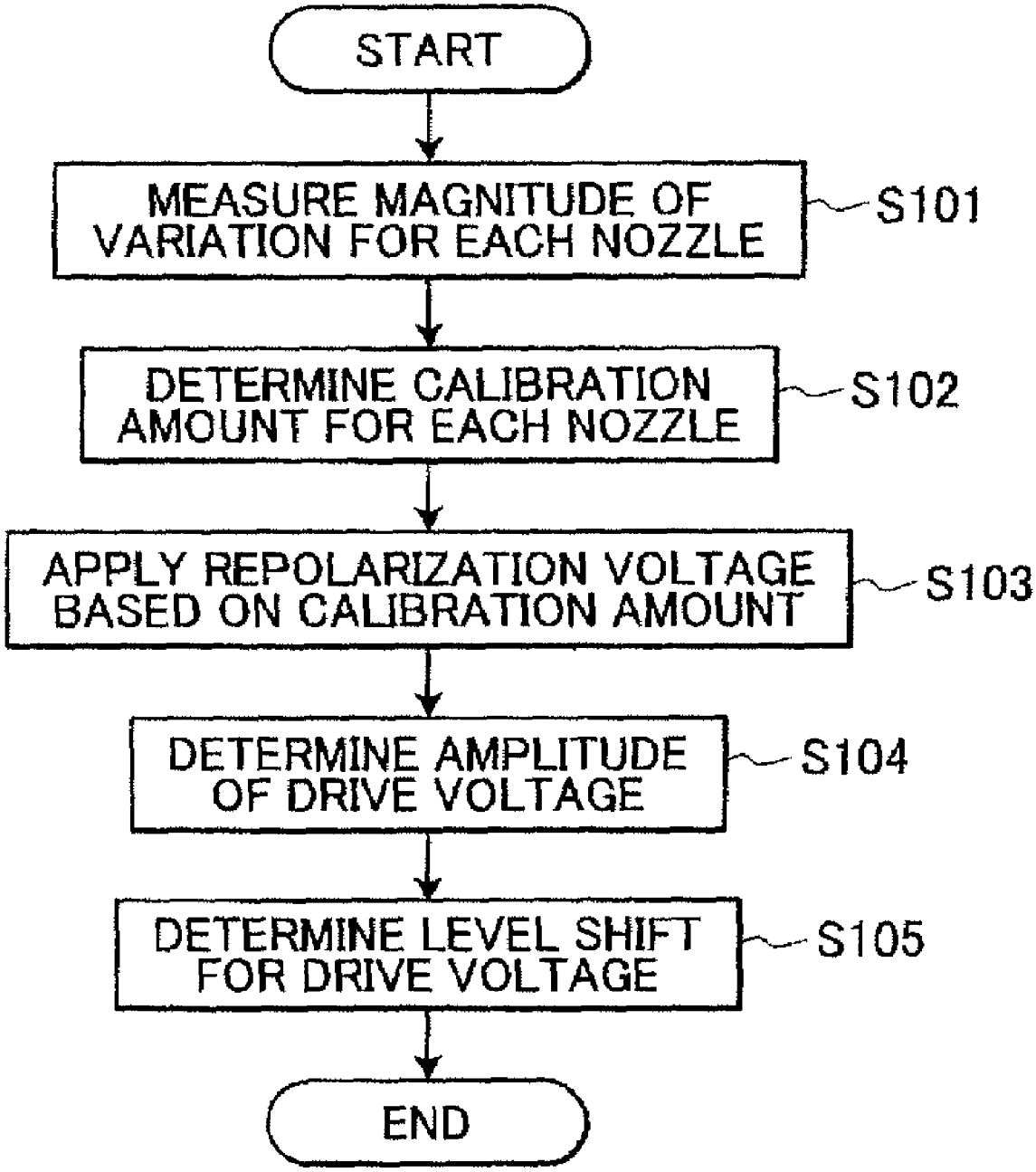
FIG. 10 is a flowchart illustrating steps in a method of calibrating ejection characteristics according to the present invention.

(2.2) Determining the Amount of Calibration for the Nozzles and Applying a Repolarization Voltage After measuring the amount of variation in each nozzle in S101 of FIG. 10, a calibration amount for correcting this variation is determined in S102.

The method of the present invention applies a repolarization voltage corresponding to the calibration amount to each piezoelectric element 110 in order to correct variation in the ejection characteristics. The degree of polarization in the piezoelectric elements 110 increases the greater the voltage applied in the polarization process and the longer the voltage is applied. Further, polarization progresses more readily the higher the temperature of the piezoelectric elements 110. In the present invention, the piezoelectric elements 110 are polarized in an ambient temperature near room temperature (about 25° C.).

Figure 5:
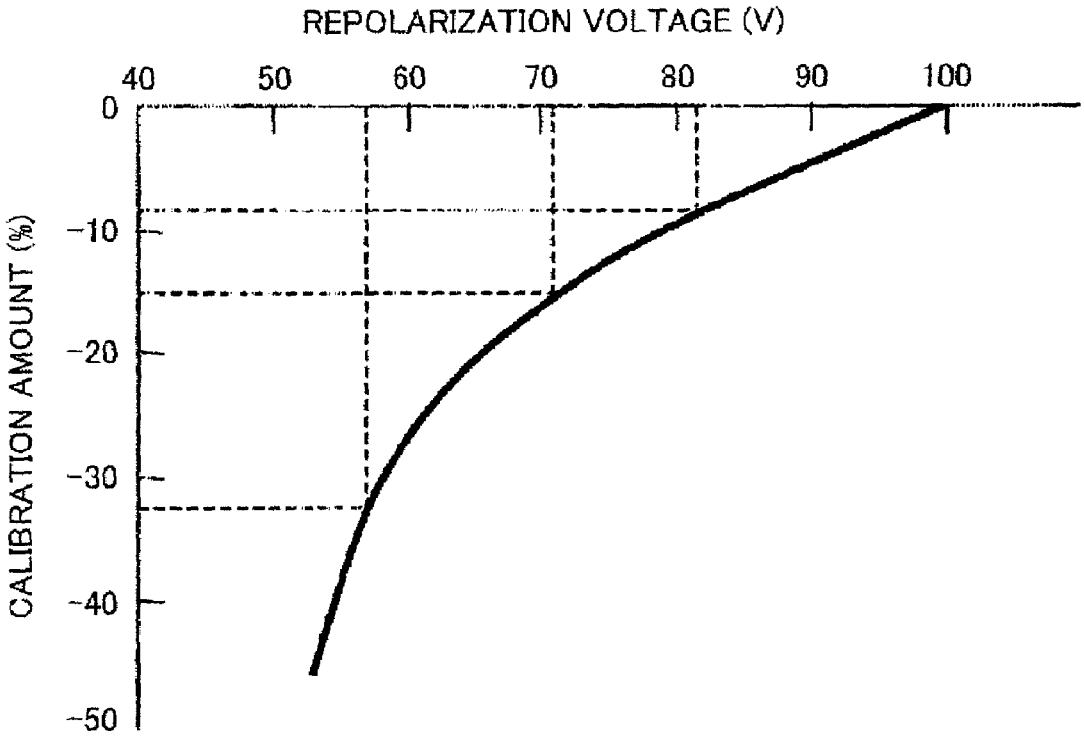
FIG. 5 is a graph for describing the calibration of the ink ejection velocity when calibrating the recording head through repolarization.

FIG. 5 is a graph showing the calibrated characteristics of polarization and ejection velocity, where the horizontal axis represents the repolarization voltage applied to the piezoelectric elements and the vertical axis represents the calibration amount for ink droplet ejection velocity. The graph shows how much the ink droplet velocity can be accelerated or decelerated based on the magnitude of the repolarization voltage applied to the piezoelectric elements 110 when repolarizing the recording head 10 at room temperature (about 25° C.).

As shown in FIG. 5, the calibration amount for the ejection velocity is 0% when the repolarization voltage is 100 V. Hence, the ink droplet ejection velocity is substantially the same as the velocity in the initial polarized state, that is, prior to calibration. When the repolarization voltage is set to 80 V, the ejection velocity reaches about −10% of the pre-calibration velocity. When the repolarization voltage is set to 55 V, the ejection velocity is some −30% the pre-calibration velocity. Hence, by setting the repolarization voltage to a suitable value between 100 and 55 V, it is possible to calibrate the ink droplet ejection velocity to a desired value in a range from 0 to 30 some percent.

Based on these characteristics, the method of the present invention applies a repolarization voltage for calibrating each of the piezoelectric elements 110 to have an ink droplet ejection velocity identical to or lower than the velocity of the slowest nozzle in the recording head 10.

In the example shown in FIG. 4A, the slowest nozzle is nozzle 6, having an ink droplet ejection velocity of about 7.0 m/s. Therefore, it is possible to set the ejection velocity for all nozzles to 7.0 m/s or lower. In the example described below, the ejection velocity for all nozzles is uniformly set to 6.7 m/s.

Since nozzle 1 has an ejection velocity of about 8.0 m/s, this nozzle must be decelerated by 1.3 m/s, which corresponds to a deceleration of −16%. As shown in FIG. 5, a repolarization voltage of about 71 V corresponds to this deceleration percentage. Since nozzle 2 has an ejection velocity of 7.3 m/s, a deceleration of 0.6 m/s (−8%) is sufficient. Here, a repolarization voltage of about 82 V is equivalent to this deceleration percentage.

Figure 4C:
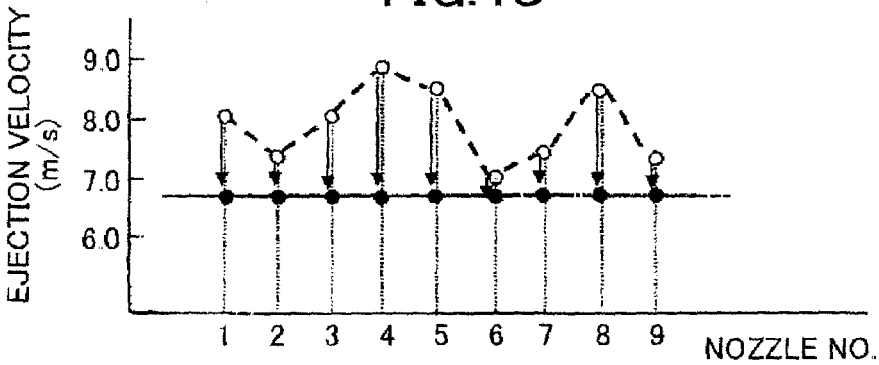

FIG. 4B is a graph plotting the repolarization voltages found above for calibrating each nozzle, where the horizontal axis represents the nozzle number and the vertical axis the repolarization voltage applied to the piezoelectric elements for calibrating the ejection velocity. By applying the repolarization voltages described above to the piezoelectric elements 110 in order to calibrate the polarization therein, the degree of polarization for the slowest nozzle 6 is set slightly lower than the pre-calibration value, that is, the initial polarized state. Similarly, the degree of polarization for piezoelectric elements corresponding to the other nozzles is set lower than the pre-calibration values. As a result, it is possible to uniformly set the ink droplet ejection velocity for all nozzles to about 6.7 m/s, which is slightly slower than the velocity of the slowest nozzle as shown in FIG. 4C.

(2.3) Compensating for the Reduced Velocity

After setting the ejection velocity for all nozzles uniformly at or lower than the velocity of the slowest nozzle in S103, a process is performed in S104 to adjust the drive voltage applied to the common electrode 1121 of the piezoelectric elements 110 in order to compensate for the drop in ejection velocity resulting from calibration. In other words, the process in S104 adjusts the amplitude of the drive voltage in order to raise the ejection velocity for all nozzles near the average velocity when the recording head was in the initial polarized state.

Figure 4D:
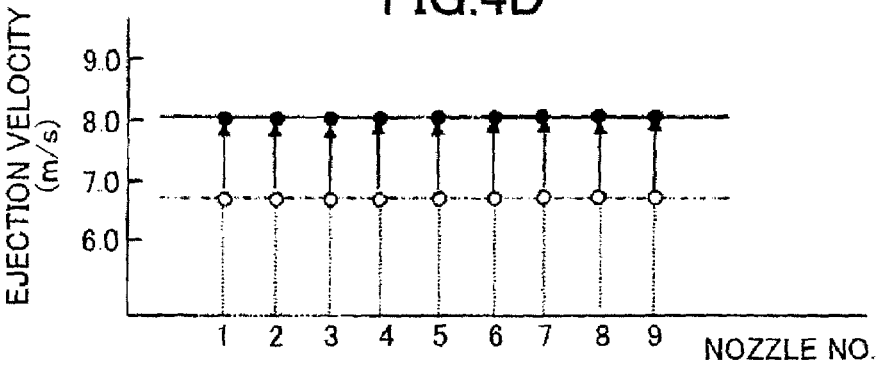
Figure 6:
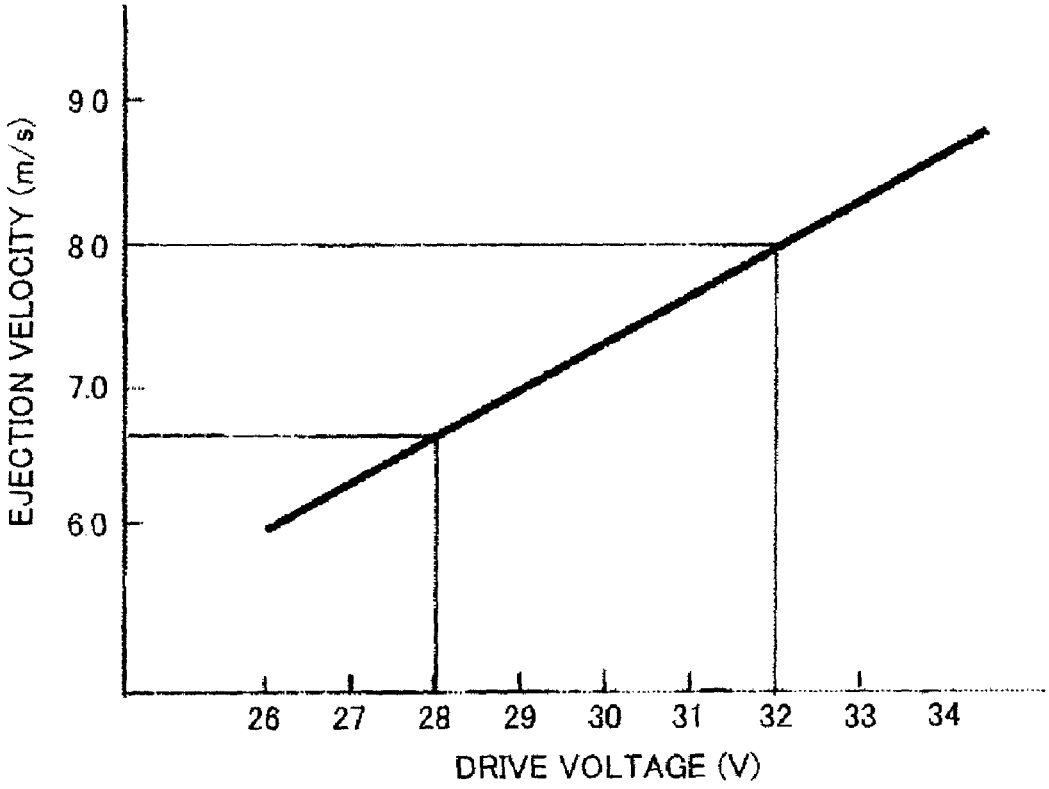
FIG. 6 is a graph illustrating corrections to a drop in ejection velocity accompanying repolarization of the recording head.

FIG. 6 shows the relationship of drive voltage to ejection velocity, where the horizontal axis represents the voltage for driving the piezoelectric elements corresponding to a nozzle and the vertical axis represents the ink droplet ejection velocity. As can be seen in the graph, by increasing the drive voltage Ve for driving the piezoelectric element from 28 V to 32 V, for example, it is possible to raise the ink droplet ejection velocity from 6.7 to 8 m/s. As a result, the ejection velocity for each of the nozzles can be uniformly set at 8 m/s, as shown in FIG. 4D.

In the preferred embodiment, while the ejection velocities of the nozzles are set uniformly at 6.7 m/s after calibration with the repolarization voltage, it is also possible to align the ejection velocities at 7.0 m/s, equivalent to the velocity of the slowest nozzle. However, in this case, the ejection velocity does not reach 7.0 m/s properly through the polarization at 100 V. Therefore, the method in the preferred embodiment sets the ejection velocities at a slightly slower speed, such as 6.7 m/s, to provide some margin in the setting. The polarization-velocity calibration characteristics shown in FIG. 5 may vary from nozzle to nozzle. In such a case, it is possible to measure the calibration characteristics for each nozzle and find the repolarization voltage for each nozzle as described above based on these characteristics, thereby improving the accuracy of calibration.

(2.4) Determining the Amount of Level Shift for the Drive Voltage

Next, in S105 of FIG. 10 the drive voltage is shifted a prescribed level in the negative direction.

While the method of the present invention applies a polarization voltage to the piezoelectric elements 110 for calibration, as described above, this process is executed near room temperature (about 25° C.). It is possible to perform the polarization calibration at the room temperature, since the degree of polarization for each nozzle is set lower than the initial polarization.

However, since the drive voltage applied to the piezoelectric elements must be increased to compensate for the drop in ink droplet ejection velocity accompanying calibration, it has been determined that the polarization calibration may worsen after the recording head has been used over a long period of time, causing the nozzles to revert to the irregular characteristics of ejection velocity present prior to calibration. To resolve this problem, a pulse waveform is generated in S105 to shift the drive voltage in the negative direction so that the voltage changes between a positive polarity and a negative polarity.

Figure 7A:
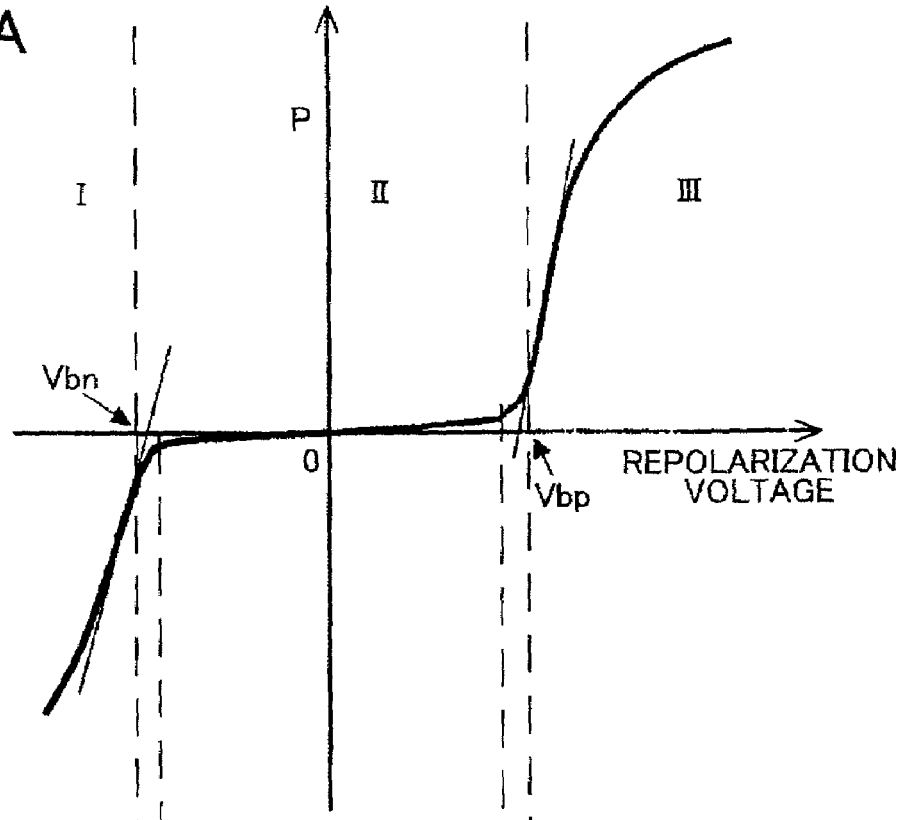
FIG. 7A is a graph showing the repolarization characteristics of the recording head.
Figure 7B:
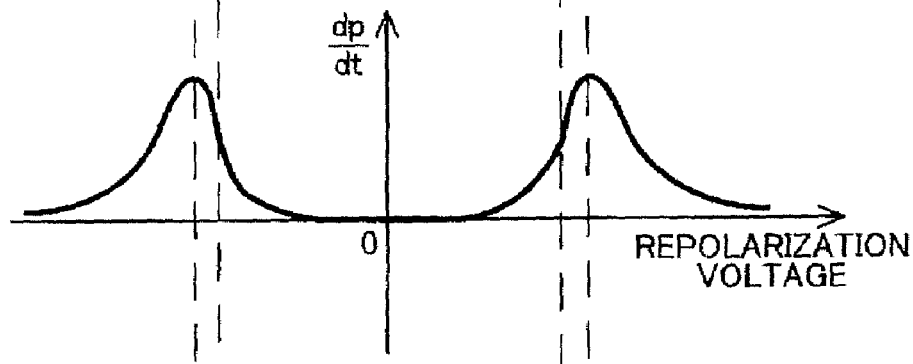
FIG. 7B is a graph showing a first differentiation of the polarization characteristics shown in FIG. 7A.
Figure 7C:
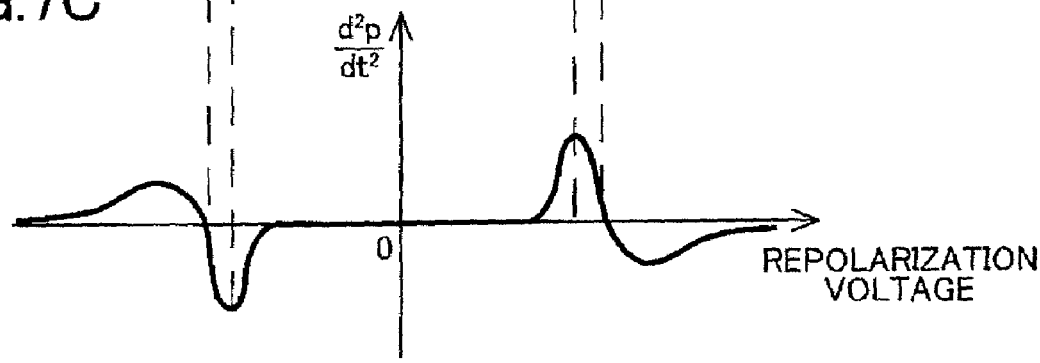
FIG. 7C is a graph showing a second differentiation of the polarization characteristics shown in FIG. 7A.

FIG. 7A shows polarization characteristics for a piezoelectric element at room temperature (25° C.), where the horizontal axis represents the repolarization voltage applied to the piezoelectric element and the vertical axis represents the degree of polarization. FIG. 7B shows a first differentiation of the polarization characteristics shown in FIG. 7A. FIG. 7C shows a second differentiation of the polarization characteristics shown in FIG. 7A.

If a repolarization voltage is applied to the piezoelectric element 110 after depolarizing the initial polarization by applying a polarization removing signal to the piezoelectric element 110, the degree of polarization increases along with an increase in the repolarization voltage, as shown in the graph of FIG. 7A. The direction of polarity for repolarization is the same forward direction as the direction of polarity of the voltage applied for the initial polarization. However, the increase in degree of polarization is extremely small when the repolarization voltage is low. The degree of polarization begins to increase rapidly when the repolarization voltage exceeds a prescribed voltage Vbp. The prescribed voltage Vbp corresponds to an extremal value of the first differentiation of the polarization characteristics in FIG. 7B that is the smallest polarization voltage among plus polarization voltages corresponding to the extremal values.

The piezoelectric elements show similar characteristics when repolarized to the opposite polarity of that applied during the initial polarization. Specifically, the degree of polarization increases only slightly in response to increases in the repolarization voltage in the direction of negative polarity, but increases abruptly in response to small increases in repolarization voltage upon exceeding a prescribed voltage Vbn. The prescribed voltage Vbn corresponds to an extremal value of the first differentiation of the polarization characteristics in FIG. 7B that is the largest polarization voltage among minus polarization voltages corresponding to the extremal values.

After calibrating the recording head 10 at room temperature according to the method of the present invention, if the conventional voltage for driving the piezoelectric element shown in FIG. 3A is applied to the piezoelectric element, if the piezoelectric elements are driven for a long time, where Ve>Vbp, or if the piezoelectric elements are driven in a high-temperature state, the voltage for driving the piezoelectric element acts as a repolarization voltage, causing the element to be polarized and erasing the polarized state achieved through calibration. Hence, it has been determined that these factors will again increase the irregularities in ejection velocities among nozzles in the droplet ejecting device.

Accordingly, as described above, the recording head drive unit 20 of the present invention generates a drive voltage having the waveform shown in FIG. 3B and applies this voltage to the common electrode 1121 of the piezoelectric elements 110. Specifically, while the magnitude of the drive voltage Ve from peak to peak is identical to the conventional value, a voltage Ve2 in the direction of forward polarity applied to the piezoelectric element 110 is set such that 0<Ve2<Vbp, while the voltage Ve1 in the direction of reverse polarity applied to the piezoelectric element 110 is set such that Vbn<Ve1<0.

A recording head that performs polarization calibration according to the method of the present invention requires a Ve of 32 V. At the same time, the Vbp and Vbn of polarization characteristics for the piezoelectric elements are 30 V and −30 V, respectively, as shown in FIGS. 7A-7C. Hence, driving the piezoelectric elements with the conventional waveform shown in FIG. 3A results in Ve>Vbp, which can undo the polarization calibration when the elements are driven for a long period of time or at a high temperature. However, by setting the Ve1 to −12 V and the Ve2 to 20 V in the waveform of FIG. 3B, the recording head drive unit of the present invention can retain a Ve of 32 without exceeding the Vbp and Vbn, thereby maintaining the calibrated degree of polarization.

Further, when the Vbp is 30 V and the Vbn −30 V, the drive voltage Ve for driving the piezoelectric elements can be raised to near 60 V . Accordingly, the method in this case can be applied to recording heads having low efficiency, since the polarization calibration can accommodate a wider range of ejection irregularities. The method of the present invention can also accommodate cases in which the piezoelectric elements are in a high-temperature state, for example, when using hot ink, in which cases repolarization progresses readily and the absolute values of Vbp and Vbn tend to be smaller.

Using the calibration method described above, it has been confirmed that variations in ejection velocities among nozzles of the recording head in the range of about ±20% can be reduced to within ±3%.

Since polarization calibration in the method of the present invention can be performed at room temperature, this method has an advantage over the conventional method of heating the piezoelectric elements to a high temperature for calibration in that productivity can be improved without the time and effort required for heating and controlling the temperature of the piezoelectric elements. Further, the method of the present invention simplifies the calibration process by eliminating the need for extra equipment such as heaters.

The calibration method of the present invention can produce a droplet ejecting device having a long life and little discrepancy in ink droplet ejection velocity among nozzles. Accordingly, an inkjet recording device equipped with such a droplet ejecting device can record high-quality images at a high speed and with excellent reliability.

(3) Structure of a Droplet Ejecting Device According to a Second Embodiment

Next, a second embodiment of the present invention will be described with reference to FIG. 8. The second embodiment differs from the first embodiment in the structure of the piezoelectric element drive switching circuit 304. Further, the piezoelectric element drive pulse wave generating circuit 305 and piezoelectric element drive voltage polarity distribution circuit 306 are omitted in the second embodiment.

The piezoelectric element drive switching circuit 304 according to the second embodiment includes two switching elements 3041L and 3041H for each nozzle that are connected in series and alternately opened and closed. The two switching elements 3041L and 3041H are operated in two open/closed modes. In a first L mode, the switching element 3041L positioned on the ground side and having one end grounded is turned on, while the switching element 3041H positioned on the voltage application side with one end connected to a direct current power supply Ve is switched off.

In a second H mode, the switching element 3041L is turned off, while the switching element 3041H is turned on. The point at which the switching element 3041H and switching element 3041L are connected is connected to the discrete electrode of the corresponding piezoelectric element. The common electrode of the piezoelectric elements is connected to a power supply Ve2. The switching element drive circuit 3042 connected to the piezoelectric element drive data signal generating circuit 303 and timing signal generating circuit 301 drives these switching elements 3041.

Next, operations of the droplet ejecting device according to the second embodiment will be described with reference to FIGS. 9A to 9C.

Figure 8:
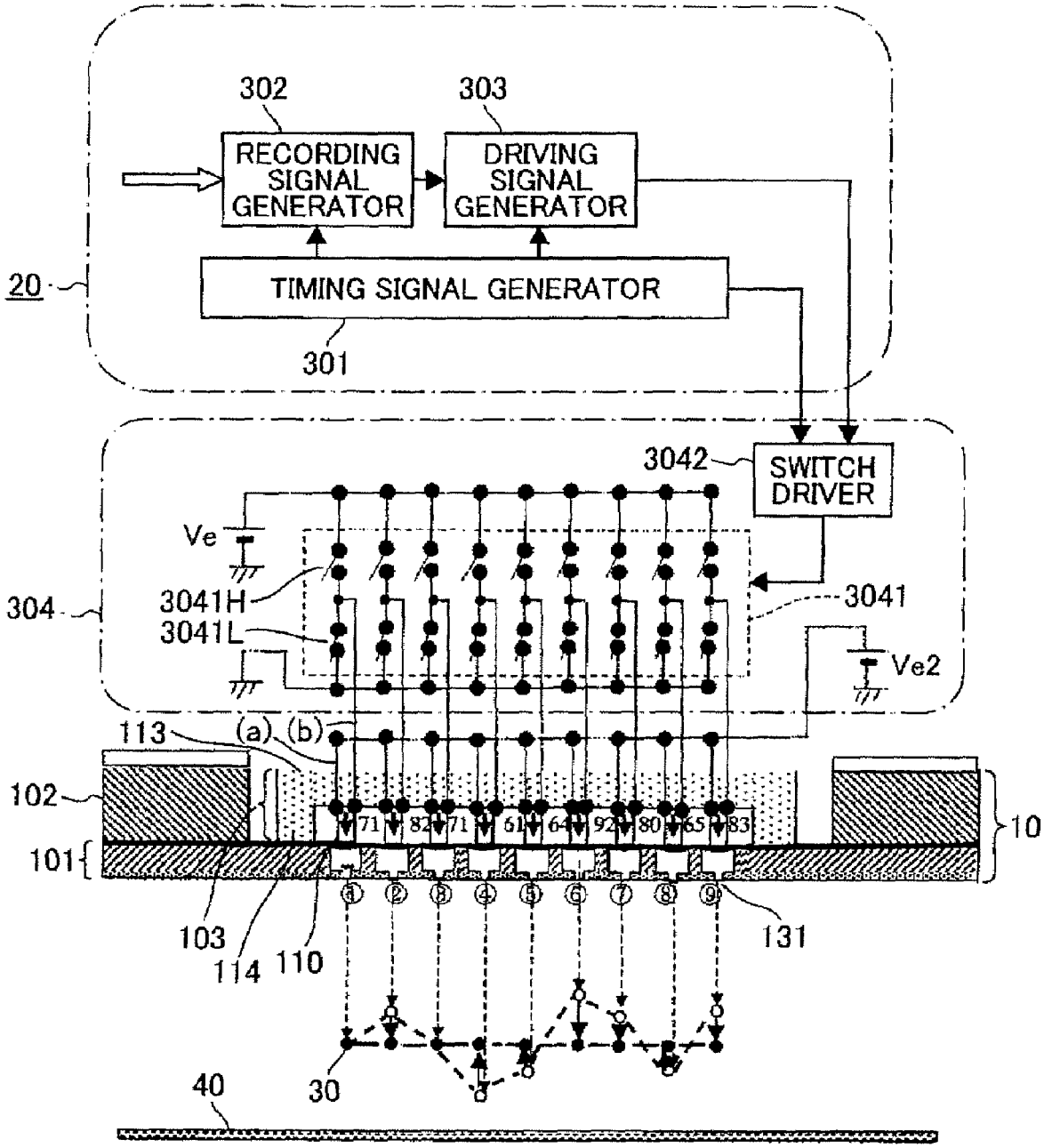
FIG. 8 is a schematic diagram showing a droplet ejecting device according to a second embodiment.
Figure 9A:
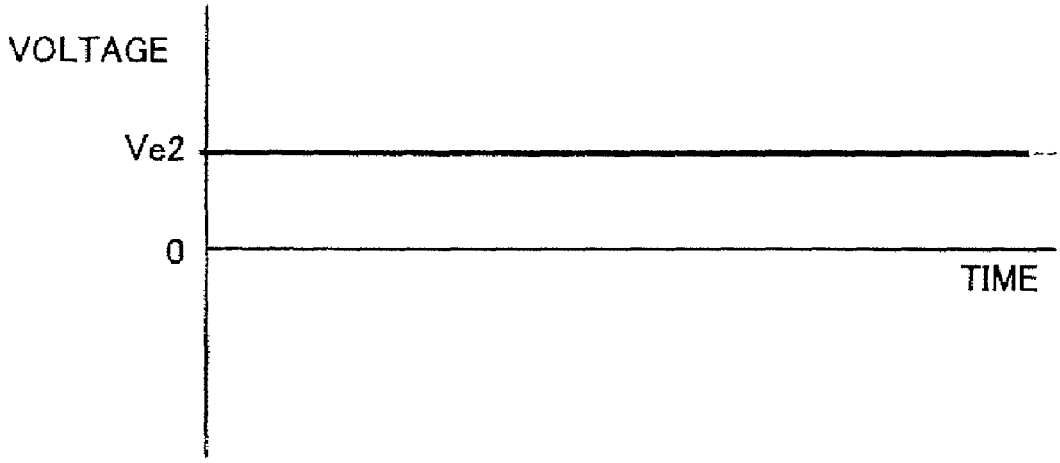
FIGS. 9A to 9C are waveform diagrams illustrating the operations of a recording head drive unit according to the second embodiment.
Figure 9B:
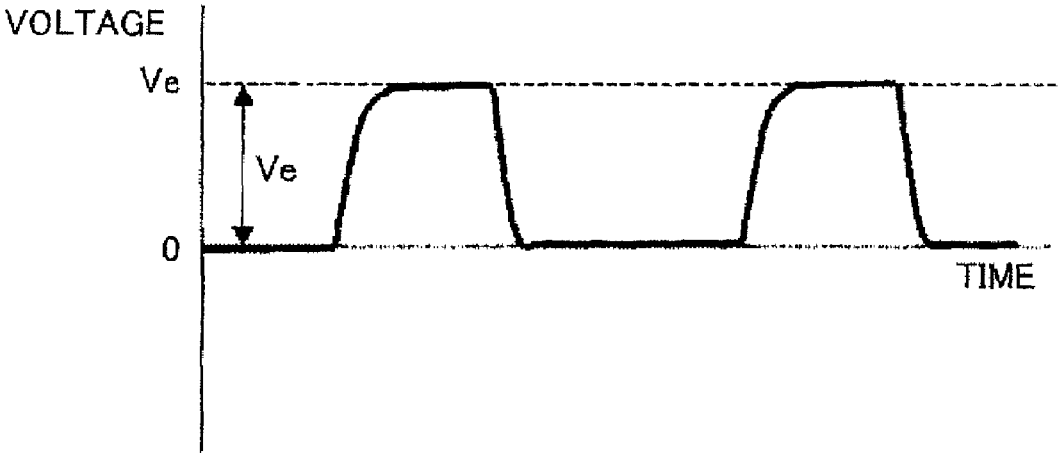
Figure 9C:
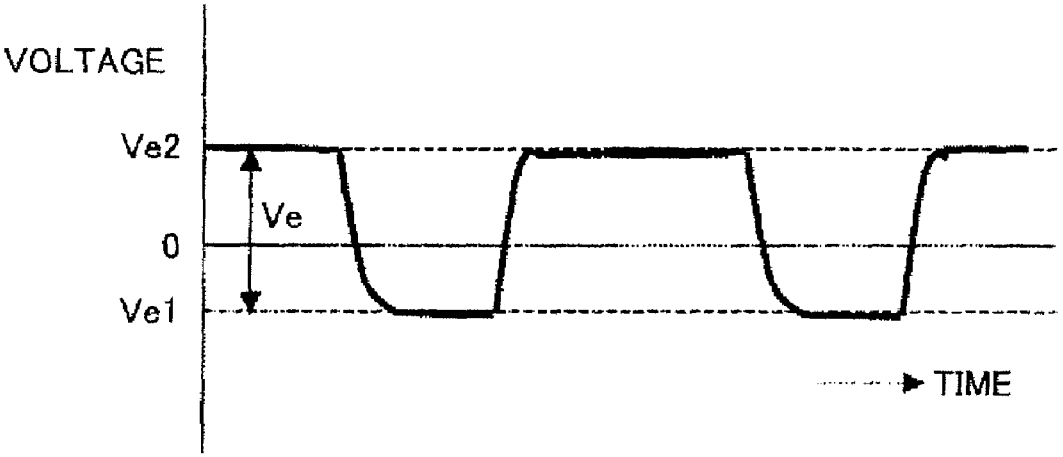

FIGS. 9A and 9B are the waveforms produced at points (a) and (b) shown in FIG. 8. Specifically, FIG. 9A shows the potential on the common electrode side of the piezoelectric element 110, while FIG. 9B shows the waveform on the discrete electrode side. FIG. 9C is the waveform resulting from subtracting the potential in FIG. 9B from the potential in FIG. 9A and indicates the potential of the common electrode relative to the discrete electrode.

In order to eject ink from a nozzle, the corresponding switching element 3041 is driven to change from the first L mode to the second H mode. As a result, the potential of the common electrode relative to the discrete electrode changes from Ve2−0=Ve2 to Ve2−Ve=Ve1. Thus, the polarity of the voltage changes from the forward polarity, which was the polarity applied when polarizing the piezoelectric element, to the reverse polarity, thereby reducing the pressure in the ink pressure chamber 140. Subsequently, the switching element 3041 is driven to change from the second H mode back to the first L mode, changing the potential of the common electrode relative to the discrete electrode from Ve2−Ve=Ve1 to Ve2−0=Ve2 and returning the applied voltage to the forward polarity. Accordingly, pressure is increased in the ink pressure chamber 140, causing an ink droplet to eject.

While the structure and operations of the recording head drive unit 20 according to the second embodiment differ from those according to the first embodiment, the voltage applied to the piezoelectric elements 110 is unchanged. In other words, the piezoelectric elements can be driven by distributing the drive voltage Ve between Ve1 of Ve2 having opposite polarity, thereby achieving the same effects as described in the first embodiment.

Since the droplet ejecting device according to the second embodiment does not require the piezoelectric element drive pulse wave generating circuit 305 and piezoelectric element drive voltage polarity distribution circuit 306, the recording head drive unit 20 can be manufactured at a lower cost.

(4) Variations of the Embodiments

While the invention has been described in detail with reference to specific embodiments thereof, it would be apparent to those skilled in the art that many modifications and variations may be made therein without departing from the spirit of the invention, the scope of which is defined by the attached claims.

For example, the preferred embodiments described a case of applying the present invention to an on-demand inkjet recording head having a "push" type piezoelectric element system. However, it should be apparent that the present invention may be similarly applied to an on-demand inkjet recording head having a "bending" type piezoelectric element system with plate-shaped piezoelectric elements formed on a diaphragm surface.

Further, the preferred embodiments describe the case of calibrating ink droplet ejection velocity by calibrating polarization. However, it is also possible to calibrate the weight of ejected ink droplets by adjusting the polarization voltage. In other words, by replacing the ink droplet ejection velocity in the preferred embodiments with ink droplet ejection weight, calibration of the droplet weight can also be performed with less time and effort, thereby improving productivity and producing a recording head with a smaller range in deviations of ink droplet weight.

The recording head and drive unit of the present invention are suitable for use in a serial inkjet recording device or a line type inkjet recording device. In the serial inkjet recording device, the recording head of the present invention is disposed so that the orifice surface opposes the recording medium. The recording head is moved in a main scanning direction that intersects the longitudinal direction of a continuous recording medium while ejecting ink droplets based on recording signals to record one line at a time. Subsequently, the recording medium is conveyed a prescribed line width in a subscanning direction corresponding to the longitudinal direction of the medium, and the recording head continues to record the next line of the image. The entire image is recorded by repeatedly performing the main scan and sub scan.

In the line type inkjet recording device, a plurality of recording heads according to the present invention are arranged across the width of the continuous recording medium and oppose the surface of the recording medium across the entire width. The recording heads eject ink droplets based on recording signals. At the same time, the continuous recording medium is moved at a high rate of speed in a main scanning direction equivalent to the longitudinal direction of the medium. An image is formed on the recording medium by controlling the main scan and ejection of ink droplets so that dots are recorded in prescribed positions along scanning lines. In this way, the inkjet recording device according to the present invention can print high-quality images at a high speed.

In the embodiment, the points where the degree of polarization begins to increase are identified by the extremal values. However, the points may be identified by regions I, II and III as shown in FIG. 7A.

In addition to an inkjet recording device for recording images on a recording medium in ink, the present invention may also be applied to industrial equipment for liquid distribution, such as a product marking device and a coating device.

While the invention has been described in detail with reference to the specific embodiment thereof, it would be apparent to those skilled in the art that various changes and modifications may be made therein without departing from the spirit of the invention.

For example, the prescribed voltage Vbp may correspond to an extremal value of the secondary differentiation of the polarization characteristics in FIG. 7C that is the smallest polarization voltage among plus polarization voltages corresponding to the extremal values, and the prescribed voltage Vbn may correspond to an extremal value of the second differentiation of the polarization characteristics in FIG. 7C that is the largest polarization voltage among minus polarization voltages corresponding to the extremal values.

What is claimed is:

1. A droplet ejecting device comprising:

a nozzle unit formed with a plurality of nozzles configured to eject ink droplets;

a piezoelectric member formed with a plurality of piezoelectric elements provided in one-to-one correspondence with the plurality of nozzles, each of said piezoelectric elements having a common electrode and a discrete electrode, and is polarized based on a polarization voltage applied between the common electrode and the discrete electrode, and expands and contracts based on change in a voltage difference between the common electrode and the discrete electrode, wherein a first differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values; and a drive voltage generating unit configured to generate a drive voltage having a range between a first negative voltage Ve1 and a first positive voltage Ve2, and apply the drive voltage between the common electrode and the discrete electrode, wherein Vbp, Vbn, Ve1, and Ve2 are set such that $Vbn<Ve1<0$ and $0<Ve2<Vbp$.

2. The droplet ejecting device according to claim 1, wherein the drive voltage generating unit generates a first pulse having a first voltage range between Ve1 and Ve2, and applies the first pulse between the common electrode and the discrete electrode.

3. The droplet ejecting device according to claim 2, wherein the drive voltage generating unit comprises:

a pulse generating unit configured to generate a second pulse having a single voltage polarity and a second voltage range between a second negative voltage Ve3 and a second positive voltage Ve4, and apply the second pulse between the common electrode and the discrete electrode, a voltage difference between Ve3 and Ve4 being equivalent to a voltage difference between Ve1 and Ve2; and a polarity distribution unit configured to shift the second voltage range to the first voltage range.

4. The droplet ejecting device according to claim 1, wherein the drive voltage generating unit comprises:

a first DC voltage generating unit configured to apply Ve2 to the common electrode; and a second DC voltage generating unit configured to apply a DC voltage Ve to the discrete electrode based on an ejection condition, where $Ve=|Ve1|+|Ve2|$.

5. The droplet ejecting device according to claim 4, wherein the drive voltage generating unit further comprises a connecting unit disposed between the second DC voltage generating unit and the discrete electrode to connect the second DC voltage generating unit with the discrete electrode based on the ejection condition.

6. The droplet ejecting device according to claim 5, wherein the connecting unit comprises:

first switching elements each disposed between the discrete electrode and ground; and second switching elements each disposed between the second DC voltage generating unit and the discrete electrodes.

7. A droplet ejecting device comprising:

a nozzle unit formed with a plurality of nozzles configured to eject ink droplets;

a piezoelectric member formed with a plurality of piezoelectric elements provided in one-to-one correspondence with the plurality of nozzles, each of said piezoelectric elements having a common electrode and a discrete electrode, and is polarized based on a polarization voltage applied between the common electrode and the discrete electrode, and expands and contracts based on change in a voltage difference between the common electrode and the discrete electrode, wherein a secondary differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values; and a drive voltage generating unit configured to generate a drive voltage having a range between a first negative voltage Ve1 and a first positive voltage Ve2, and apply the drive voltage between the common electrode and the discrete electrode, wherein Vbp, Vbn, Ve1, and Ve2 are set such that Vbn<Ve1<0 and 0<Ve2<Vbp.

8. A method of calibrating ejection characteristics for a droplet ejecting device including a plurality of nozzles ejecting ink droplets; and a plurality of piezoelectric elements provided in one-to-one correspondence with the plurality of nozzles, each piezoelectric element having a common electrode and a discrete electrode, and being polarized based on a polarization voltage applied between the common electrode and the discrete electrode, and expanding and contracting based on a change in a voltage difference between the common electrode and the discrete electrode, the method comprising:

a first step for measuring variation in droplet ejection characteristics among the plurality of nozzles;

a second step for applying a polarization voltage to the plurality of piezoelectric elements based on the measured variation so that droplet ejection velocity from each nozzle is equivalent to or lower than that of the nozzle having the slowest droplet ejection velocity; and a third step for applying a drive voltage Ve to the plurality of piezoelectric elements in order to uniformly increase ejection velocity of the plurality of nozzles.

9. The method according to claim 8, wherein a secondary differentiation by polarization voltage of a characteristic curve indicating change in a polarization of each piezoelectric element with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values, wherein Ve has a voltage range between a first negative voltage Ve1 and a first positive voltage Ve2, and Vbp, Vbn, Ve1, and Ve2 are set such that Vbn<Vel<0 and 0<Ve2<Vbp.

10. The method according to claim 8, wherein the second step is performed at room temperature.

11. An inkjet recording device comprising:

a nozzle unit formed with a plurality of nozzles configured to eject ink droplets;

a piezoelectric member formed with a plurality of nozzles, and the piezoelectric member is formed with a plurality of piezoelectric elements provided in one-to-one correspondence with the plurality of nozzles, each piezoelectric element having a common electrode and a discrete electrode, and is polarized based on a polarization voltage applied between the common electrode and the discrete electrode, and expands and contracts based on change in a voltage difference between the common electrode and the discrete electrode, wherein a first differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values; and a drive voltage generating unit configured to generate a drive voltage having a range between a first negative voltage Ve1 and a first positive voltage Ve2, and apply the drive voltage between the common electrode and the discrete electrode, wherein Vbp, Vbn, Ve1, and Ve2 are set such that Vbn<Ve1<0 and 0<Ve2<Vbp.

12. The inkjet recording device according to claim 11, wherein the drive voltage generating unit generates a first pulse having a first voltage range between Ve1 and Ve2, and applies the first pulse between the common electrode and the discrete electrode.

13. The inkjet recording device according to claim 12, wherein the drive voltage generating unit comprises:

a pulse generating unit configured to generate a second pulse having a single voltage polarity and a second voltage range between a second negative voltage Ve3 and a second positive voltage Ve4, and apply the second pulse between the common electrode and the discrete electrode, a voltage difference between Ve3 and Ve4 being equivalent to a voltage difference between Ve1 and Ve2; and a polarity distribution unit configured to shift the second voltage range to the first voltage range.

14. The inkjet recording device according to claim 11, wherein the drive voltage generating unit comprises:

a first DC voltage generating unit configured to apply Ve2 to the common electrode; and a second DC voltage generating unit configured to apply a DC voltage Ve to the discrete electrode based on an ejection condition, where Ve=|Ve1|+|Ve2|.

15. The inkjet recording device according to claim 14, wherein the drive voltage generating unit further comprises a connecting unit disposed between the second DC voltage generating unit and the discrete electrode to connect the second DC voltage generating unit with the discrete electrode based on the ejection condition.

16. The inkjet recording device according to claim 15, wherein the connecting unit comprises:

first switching elements each disposed between the discrete electrode and ground; and second switching elements each disposed between the second DC voltage generating unit and the discrete electrodes.

17. An inkjet recording device comprising:

a nozzle unit formed with a plurality of nozzles configured to eject ink droplets;

a piezoelectric member formed with a plurality of nozzles, and the piezoelectric member is formed with a plurality of piezoelectric elements provided in one-to-one correspondence with the plurality of nozzles, each piezoelectric element having a common electrode and a discrete electrode, and is polarized based on a polarization voltage applied between the common electrode and the discrete electrode, and expands and contracts based on change in a voltage difference between the common electrode and the discrete electrode, wherein a secondary differentiation by polarization voltage of a characteristic curve indicating change in a polarization of the piezoelectric member with respect to change in the polarization voltage has a plurality of extremal values including a first extremal value at a prescribed positive voltage Vbp that is the smallest polarization voltage among plus polarization voltages corresponding to the plurality of extremal values, and a second extremal value at a prescribed negative voltage Vbn that is the largest polarization voltage among minus polarization voltages corresponding to the plurality of extremal values; and a drive voltage generating unit configured to generate a drive voltage having a range between a first negative voltage Ve1 and a first positive voltage Ve2, and apply the drive voltage between the common electrode and the discrete electrode, wherein Vbp, Vbn, Ve1, and Ve2 are set such that Vbn<Ve1<0 and 0<Ve2<Vbp.

* * * * *